US011643859B2

(12) United States Patent
Seppänen et al.

(10) Patent No.: US 11,643,859 B2
(45) **Date of Patent: *May 9, 2023**

(54) DOOR CLOSER ARRANGEMENT

(71) Applicant: Abloy Oy, Joensuu (FI)

(72) Inventors: Sauli Seppänen, Joensuu (FI); Juhani Karvonen, Kuopio (FI); Vesa Kärkkäinen, Joensuu (FI); Petri Sallinen, Joensuu (FI)

(73) Assignee: ABLOY OY, Joensuu (FI)

( * ) Notice: Subject to any disclaimer, the term of this patent is extended or adjusted under 35 U.S.C. 154(b) by 175 days.

This patent is subject to a terminal disclaimer.

(21) Appl. No.: 17/144,730

(22) Filed: Jan. 8, 2021

(65) Prior Publication Data

US 2021/0214982 A1 Jul. 15, 2021

(30) Foreign Application Priority Data

Jan. 9, 2020 (EP) ..... 20150837.1

(51) Int. Cl.
*E05F 1/10* (2006.01)
*E05F 3/22* (2006.01)

(52) U.S. Cl.
CPC ..... *E05F 1/10* (2013.01); *E05Y 2201/434* (2013.01); *E05Y 2201/47* (2013.01); *E05Y 2201/624* (2013.01); *E05Y 2201/64* (2013.01); *E05Y 2201/684* (2013.01); *E05Y 2201/692* (2013.01); *E05Y 2600/45* (2013.01); *E05Y 2600/46* (2013.01); *E05Y 2900/132* (2013.01)

(58) Field of Classification Search
CPC ..... E05C 17/02; E05C 17/54; E05C 17/34; E05C 17/32; E05F 3/22; E05F 3/221; E05F 3/227; E05F 1/08; E05F 1/10; E05F 2003/228; E05F 2201/412; E05F 2201/414; E05F 2201/482; E05F 2201/64; E05F 2201/652; E05F 2201/656; E05F 2201/684; E05Y 2900/132; Y10T 16/469; Y10T 16/459; Y10T 16/462; Y10T 16/593; Y10T 16/56; Y10T 16/585; Y10T 16/27; Y10T 16/281
See application file for complete search history.

(56) References Cited

U.S. PATENT DOCUMENTS 3,909,877 A * 10/1975 Christy ..... E05F 3/221 16/85
4,419,787 A * 12/1983 Lieberman ..... E05F 1/1008 16/65
4,506,407 A * 3/1985 Downey ..... E05F 3/222 16/320

(Continued)

FOREIGN PATENT DOCUMENTS

DE 202016102927 U1 6/2016
EP 2071109 A1 6/2009

*Primary Examiner* — Chuck Y Mah
(74) *Attorney, Agent, or Firm* — Muncy, Giessler, Olds & Lowe, P.C.

(57) ABSTRACT

The aim of the invention is to achieve a door closer arrangement (1) where the force needed for opening the door (2) is not so substantial. The invention comprises a door closer (6), a slide rail (7), and an arm (8) that connects the door closer with the slide rail. The arrangement comprises also a second rail (9), which is arranged to form a slide slope for the door closer (6).

16 Claims, 5 Drawing Sheets

(56) References Cited

U.S. PATENT DOCUMENTS

Figure 1:
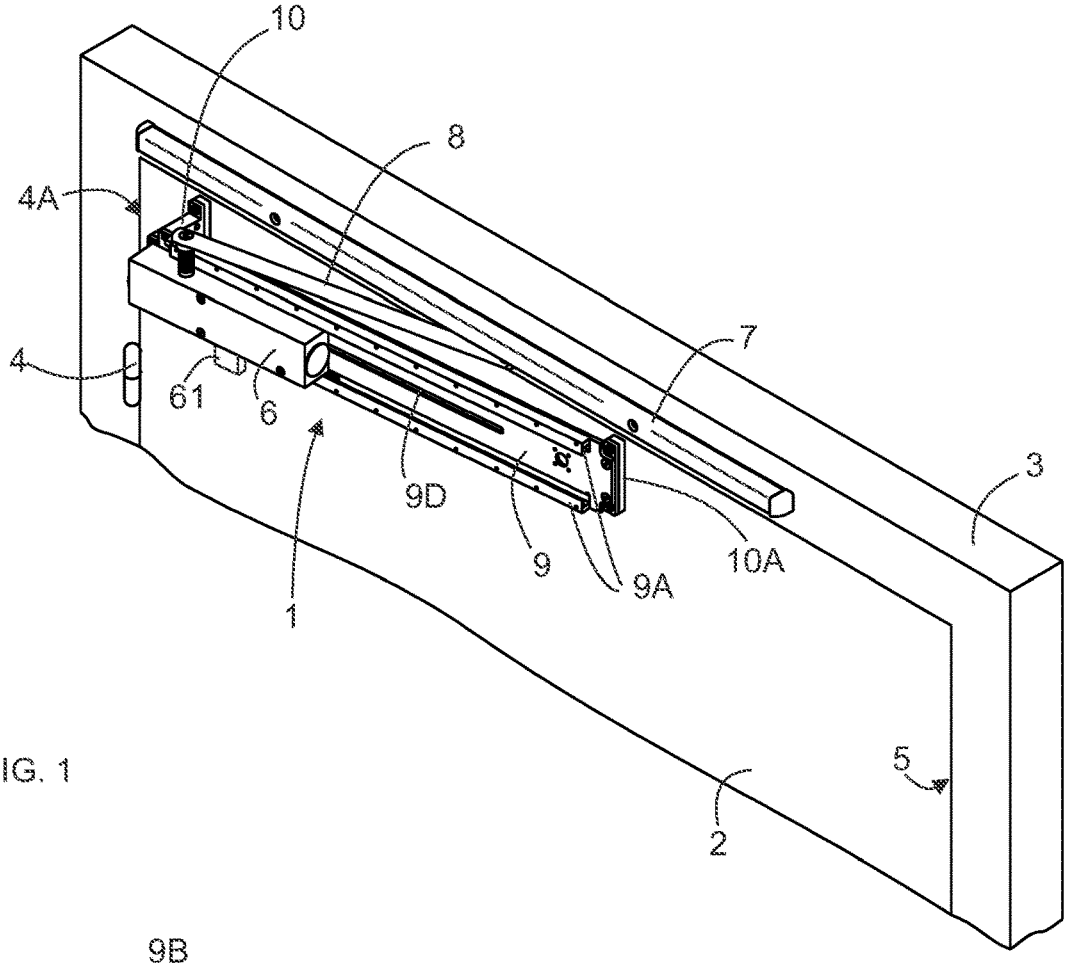

| | | | | |
|---|---|---|---|---|
| 4,759,099 | A * | 7/1988 | Morano | E05F 3/102 16/64 |
| 5,448,798 | A * | 9/1995 | Coleman | E05C 17/28 16/85 |
| 5,636,476 | A * | 6/1997 | Eikmeier | E05F 11/16 49/246 |
| 6,138,412 | A * | 10/2000 | Rieckmann | E05F 15/53 49/340 |
| 6,253,417 | B1 * | 7/2001 | Rusiana | E05C 17/28 16/65 |
| 9,238,399 | B2 | 1/2016 | Okuma et al. | |
| 2001/0007163 | A1 * | 7/2001 | Alonso | E05F 3/221 16/58 |
| 2015/0211278 | A1 * | 7/2015 | Moyer | E05F 3/102 16/52 |
| 2016/0362924 | A1 * | 12/2016 | Fan | E05F 5/08 |
| 2017/0081892 | A1 * | 3/2017 | Fan | E05F 1/105 |
| 2018/0002965 | A1 | 1/2018 | Sauter et al. | |
| 2019/0093407 | A1 * | 3/2019 | Lygin | E05F 15/63 |
| 2020/0340280 | A1 * | 10/2020 | Oakley | E05F 3/227 |
| 2021/0071458 | A1 * | 3/2021 | Eickhoff | E05F 3/227 |

* cited by examiner

DOOR CLOSER ARRANGEMENT

FIELD OF TECHNOLOGY

The invention relates to door closer arrangements, which are used when doors are closed and opened.

PRIOR ART

Door closers are used in order to close doors after the opening operations of the doors. The door closer can be mounted on the surface of a door or on the surface of a door frame. Some door closer arrangements comprise a slide rail. If the door closer has been mounted on the door, the slide rail has been mounted on the door frame, or the installation is vice versa.

When the door is opened the opening force is quite big at the small opening angles of the door. This is due to the structure of the door closer having a spring inside. The spring tensions when the door is opened. The tension of spring moves the piston of the door closer back to its initial position, i.e. moves the door to the closed position, after the opening of the door. So, the user of the door does not need to push or pull the door for closing it.

The user of the door can notice that the force needed to open the door is substantial at the beginning of the opening operation. The force needed may be experienced to be too big and therefore unpleasant. On the other hand, it may occur that when closing the door, the closing power may be not enough to close the door properly in all situations.

Short Description

The object of the invention is to achieve a door closer arrangement where the force needed for opening the door is not so substantial than in known solutions, and the closing power is improved. The aim of the invention is obtained by a door closer arrangement of an independent claim. Dependent claims illustrate different embodiments of the invention.

A door closer arrangement according to the invention comprises a door closer, a slide rail, and an arm that connects the door closer with the slide rail. The arrangement comprises also a second rail, and a carriage to be attached to the second rail in a sliding manner. The carriage is arranged to form an attachment with the door closer. The door closer arrangement also comprises a first low-friction arrangement between the second rail and the carriage, and a second low-friction arrangement between the arm and the slide rail. The door closer arrangement also comprises an auxiliary motion arrangement 61 in order to aid movement of the carriage 17 and the door closer 6 along the second rail 9.

LIST OF FIGURES

Figure 2:
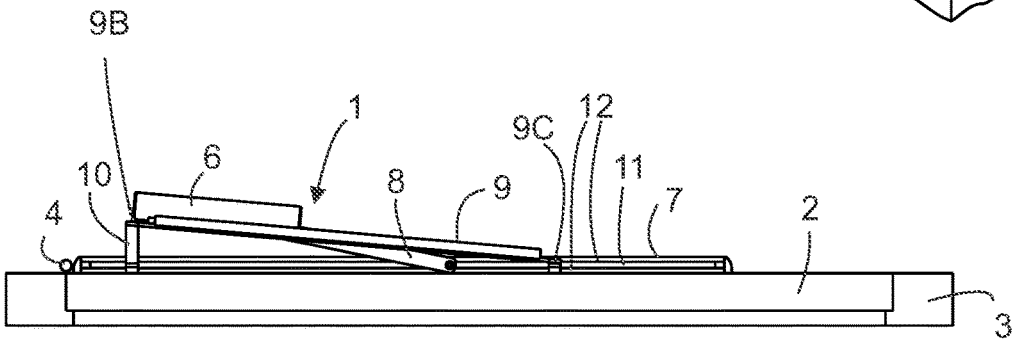
Figure 3:
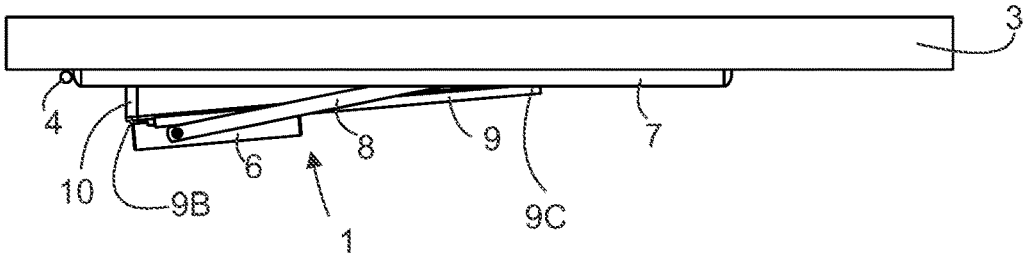
Figure 4:
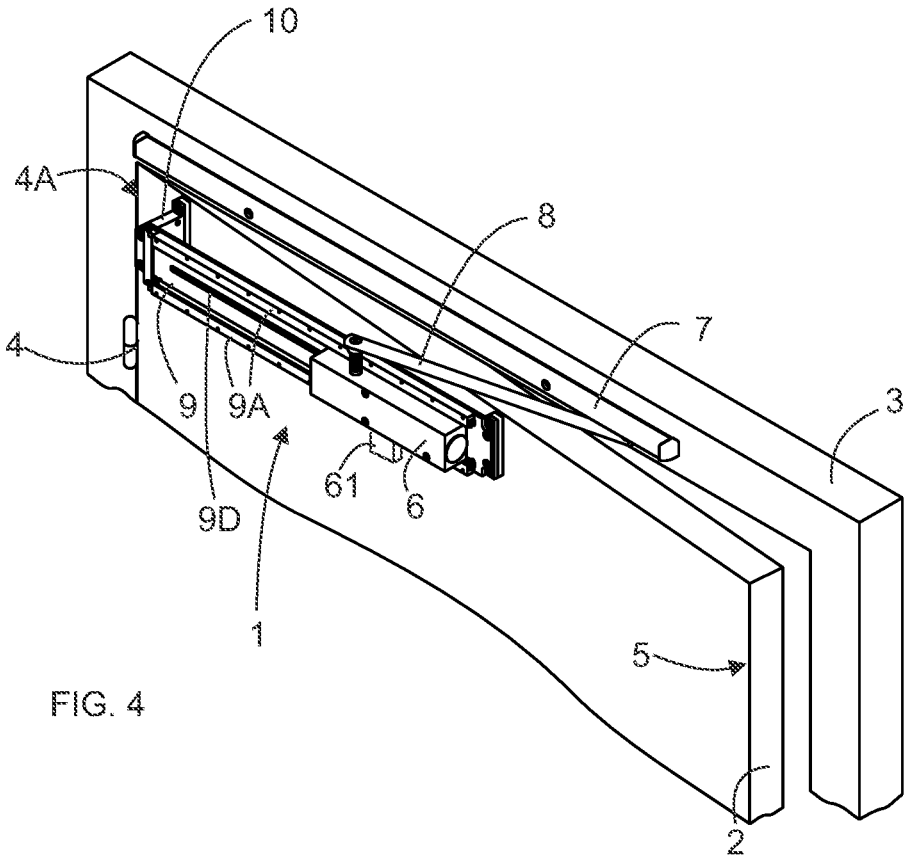
Figure 5:
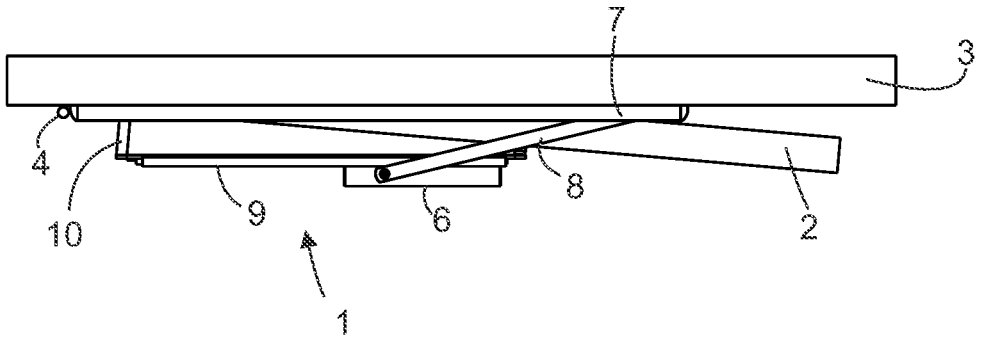
Figure 6:
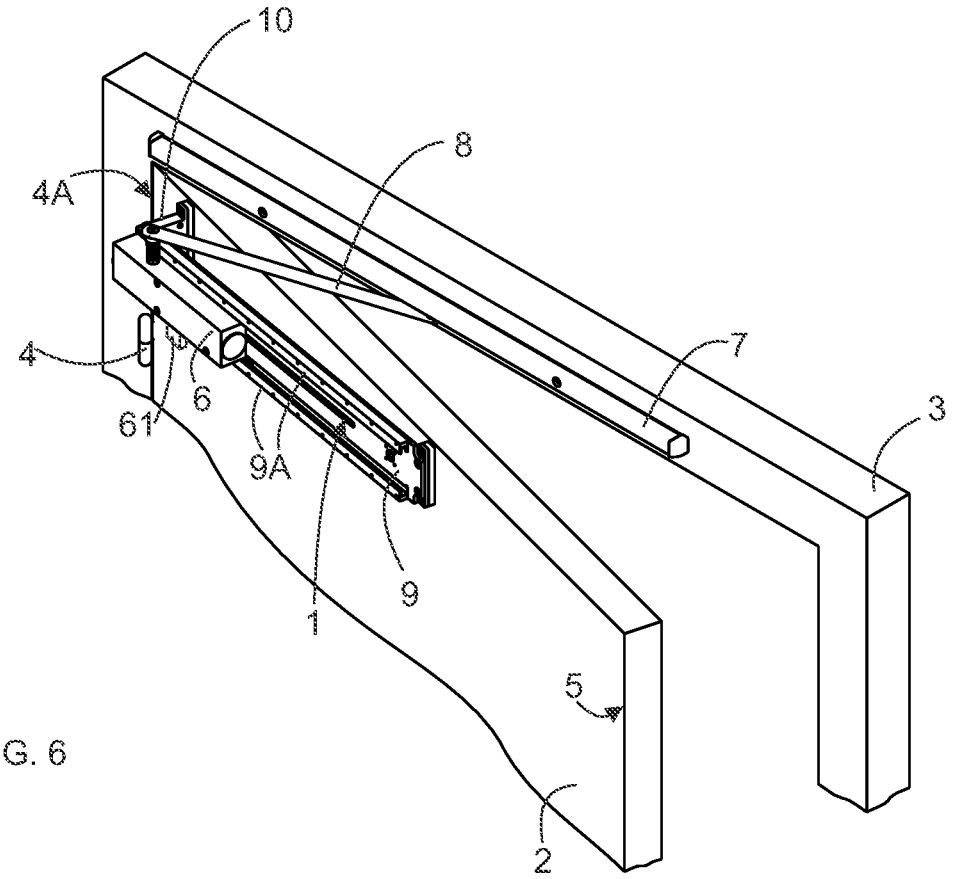
Figure 7:
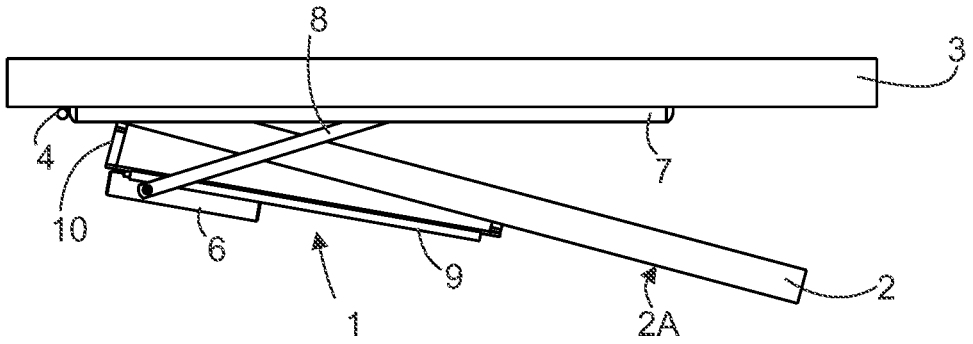
Figure 8:
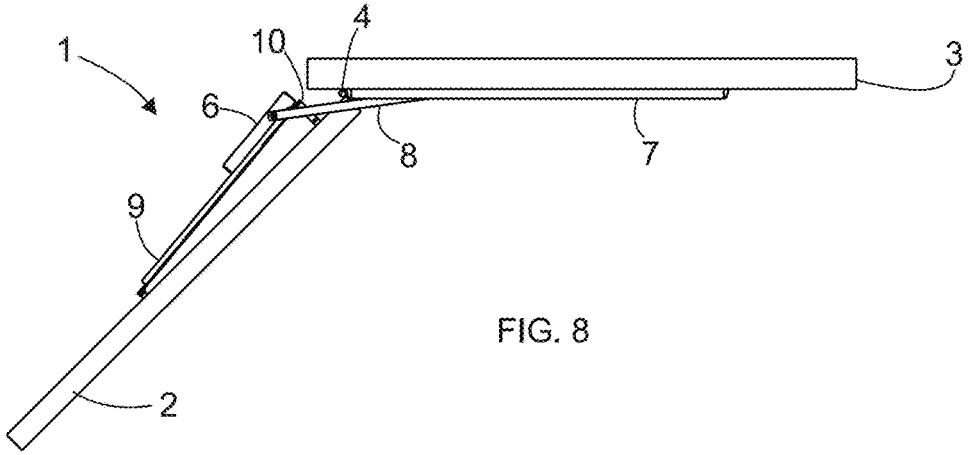
Figure 9:
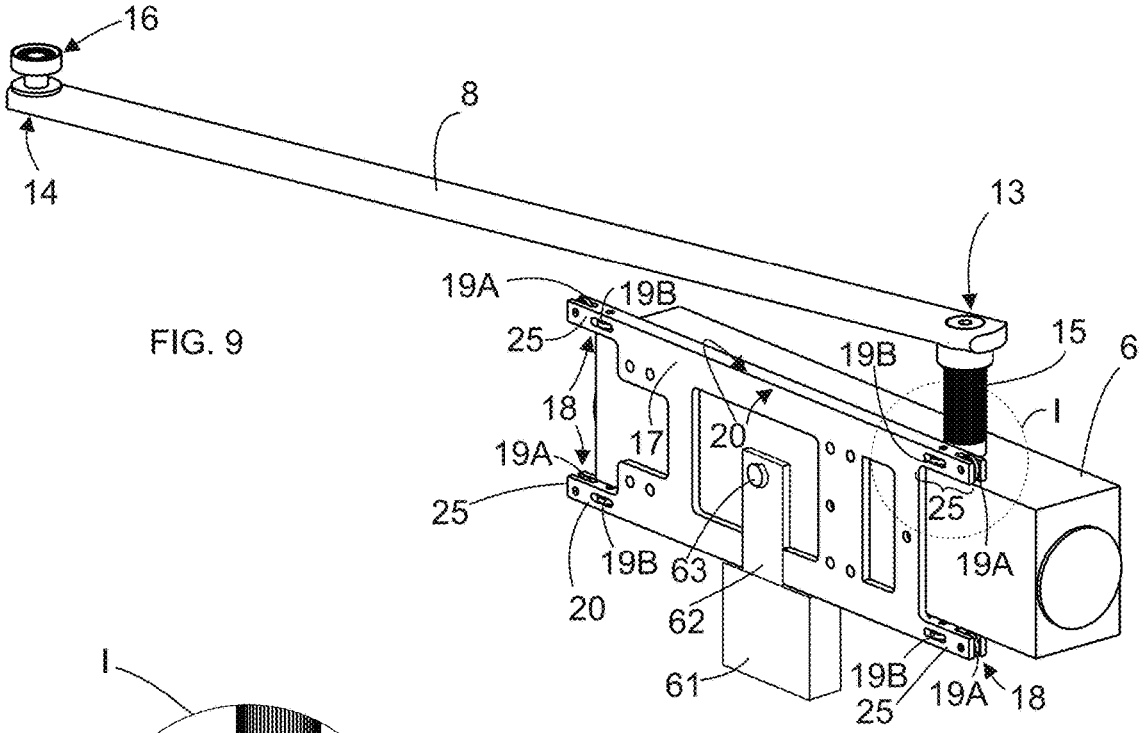
Figure 10:
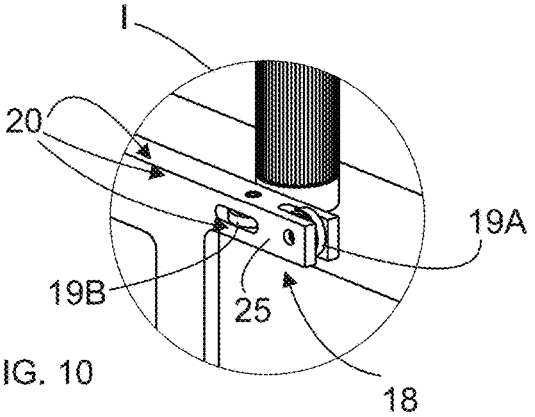
Figure 11:
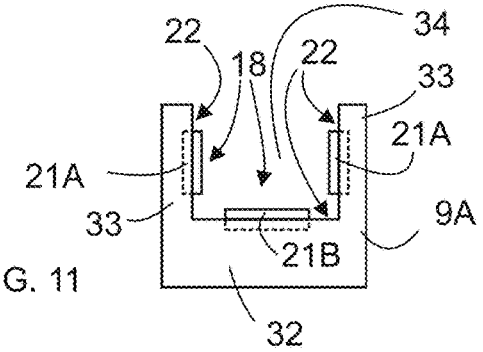
Figure 12:
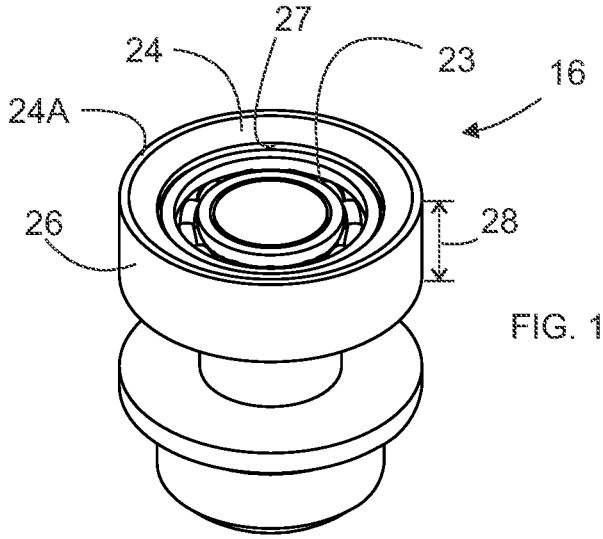
Figure 13:
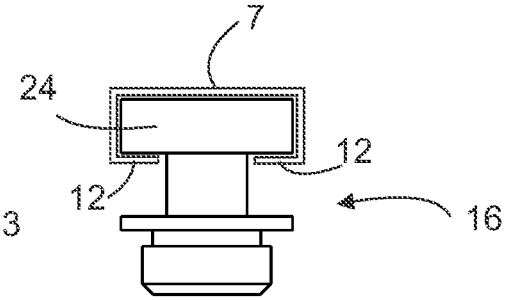
Figure 14:
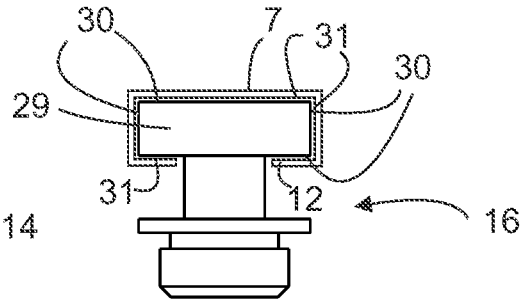
Figure 15:
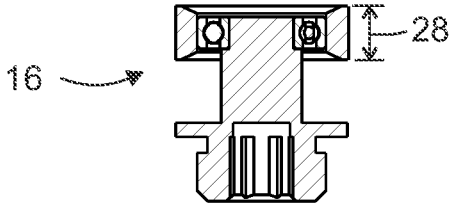

In the following, the invention is described in more detail by reference to the enclosed drawings, where FIG. 1 illustrates an example of a door closer arrangement according to the invention when a door is closed, FIG. 2 illustrates the door closer arrangement according to the invention from the bottom view when the door is closed, FIG. 3 illustrates the door closer arrangement according to the invention from the top view when the door is closed, FIG. 4 illustrates the door closer arrangement according to the invention when the door is almost closed, FIG. 5 illustrates a top view of the door closer arrangement according to the invention when the door is almost closed, FIG. 6 illustrates the door closer arrangement according to the invention when the door is open more than in FIGS. 4 and 5, FIG. 7 illustrates a top view of the door closer arrangement according to the invention when the door is open more than in FIGS. 4 and 5, FIG. 8 illustrates a top view of the door closer arrangement according to the invention when the door is fully opened, FIG. 9 illustrates embodiments of parts belonging to an arrangement according to the invention, FIG. 10 illustrates a detailed view of FIG. 9, showing bearing arrangements of the inventive embodiment, FIG. 11 illustrates other embodiments of the bearing arrangement, FIG. 12 illustrates an example of the second low-friction arrangement comprising a second bearing arrangement, FIG. 13 illustrates a side view of FIG. 12, FIG. 14 illustrates another embodiment of the second bearing arrangement, and FIG. 15 illustrates a cross-sectional view of the embodiment of FIG. 12.

DESCRIPTION OF THE INVENTION

FIG. 1 illustrates an example of a door closer arrangement 1 according to the invention when a door 2 is closed. The door closer arrangement 1 comprises a door closer 6, a slide rail 7, and an arm 8 that connects the door closer 6 with the slide rail 7. The arrangement comprises also a second rail 9, and a carriage 17 to be attached to the second rail 9 in a sliding manner. See FIG. 9. The carriage 17 is arranged to form an attachment with the door closer 6. The door closer arrangement also comprises a first low-friction arrangement 18 between the second rail 9 and the carriage 17, and a second low-friction arrangement 16 between the arm 8 and the slide rail 7. See FIG. 9. The door closer arrangement also comprises an auxiliary motion arrangement 61 in order to aid movement of the carriage 17 and the door closer 6 along the second rail 9.

As can be seen in FIG. 1, the door 2 is installed on the frame 3 of the door utilizing hinges 4. So, the side of the door towards the hinges 4 is a hinge side 4A, and the other side is a lock side 5 wherein a possible door lock is installed. FIGS. 2 and 3 show the bottom view and the top vies when the door 2 is closed. FIG. 2 shows a slot 11 and projections 12 of the slide rail 7, which are used for the attachment with the second low-friction arrangement 16.

The second rail 9 makes it possible that the door closer can move along the second rail. The movement of the door closer when opening and closing the door 2 makes the opening of the door more easy and also improves the closing of the door. FIGS. 4-8 illustrate movement of the door closer 2 at different angles of the door.

The auxiliary motion arrangement comprises an electric motor arrangement 61, or an auxiliary spring arrangement (the spring arrangement not shown in the figures). The auxiliary motion arrangement may also comprise a raising part 10 at a first end 9B of the second rail forming a slide slope for the door closer, the first end being the end to be installed nearby a hinge side 4A of a door 2 forming a slide slope for the door closer.

Further, the auxiliary motion arrangement may also comprise a second raising part 10A at a second end 9C of the second rail. The height and thus also the angle of the slide slope can be designed by the height of the raising part 10 and/or the second raising part 10A. Therefore, the slide slopes can be designed to the suitable for different door closers and different doors. The raising part 10, 10A can be integral parts with the second rail 9 or separate parts to be fixed with the second rail. The slide slope aids the movement of the door closer 2 (and the carriage 17) along the second rail 9. The second rail 9 comprises at least one slide guide 9A to form the sliding attachment to the carriage 17. The function or the auxiliary motion arrangement and the door closer arrangement are described later in this description.

As said FIG. 1 shows the door at the closed position. The door closer 6 is at the first end 9B of the second rail, i.e. near the hinge side 4A of the door. The guide rail makes it possible to situate the door closer more near the hinge side than in known solutions. So, the opening of the door is easier, which can be tedious in known solutions. When the door is opened, the door closer remains at the first end 9B of the second rail 9. FIG. 8 shows a fully opened door.

When closing the door from the fully opened position to an opening angle of about 20-30 degrees, the door closer remains at the first end 9B of the second rail 6. (The zero angle means that the door is closed.) Depending on an embodiment the door closer 9 and the carriage 17 starts to move towards the second end 9C of the second rail 9, in other words towards the lock side 5 at the opening angle of about 20-30 degrees. FIGS. 6 and 7 illustrate this situation. When the opening angle is about 10-4 degrees the door closer has moved to the second end 9C of the second rail. FIGS. 4 and 5 illustrate this situation.

The movement towards the lock side 5, is achieved by aid of the auxiliary motion arrangement, which can be the electric motor arrangement 61, or an auxiliary spring arrangement (not shown in the figures) as said above. As said, the auxiliary motion arrangement may also comprise the raising part 10 at the first end 9B of the second rail, the first end being the end to be installed nearby a hinge side 4A of a door 2 forming the slide slope for the door closer. The slide slope can actually be enough to move the door closer towards the lock side 5 of the door, so in which case the electric motor or the auxiliary spring arrangement is used only for moving the door closer back to the hinge side 4A, which is explained more later. As can be notice the slide slope is a slope in relation to the surface 2A of the door.

When the door closer 6 is at the second end 9C of the second rail 9, i.e. near the lock side 5 of the door, or when moving towards the lock side, the closing power is bigger than keeping the door closer relatively near the hinge side 4A of the door. Therefore, the door closing action is improved in relation to know solutions.

In order that the door closer can be moved back the first end 9B of the second rail after closing the door, the auxiliary motion arrangement is used. When the door is back at the closed position, the auxiliary motion arrangement moves the door closer back to the hinge side 4A. FIG. 9 shows schematically the electric motor 61 which is connected to a drive wheel 63 through a transmission connection 62. The drive wheel 63 can be friction wheel or a toothed wheel. The transmission connection can comprise a belt, a toothed belt, a chain belt etc. The drive wheel 63 is arranged to be against a drive slot 9D. The edges of the drive slot can be toothed. So, the electric motor arrangement can comprise the electric motor 61, and also the drive wheel 63, the transmission 62 and the drive slot 9D. The electric motor can be a normal (rotating) motor or a linear motor. The electric motor can be arranged to use a battery or an external power as a power source. As said, the auxiliary motion arrangement can also be the spring arrangement.

When using the slide slope as moving the door closer towards the lock side 5, the electric motor arrangement is convenient to have a one-way clutch function, which means that the electric motor 61, the drive wheel 63, and/or the transmission connection 62 do not cause any extra resistance against the movement of the door closer towards the lock side 5. When the door closer is moved towards the hinge side 4A, the one-way clutch function connects the electric motor to drive the drive wheel 63.

FIG. 9 illustrates the carriage 17, the door closer 6 attached to the carriage, and the arm 8. The door closer is attachable to the carriage, for example, using screws or bolts. The arm is attachable to the turning axis 15 of the door closer at the first end 13 of the arm. The arm is attachable to the slide rail 7 at the second end 14 of the arm.

FIG. 9 shows also the first low-friction arrangement 18 and the second low-friction arrangement 16. In order that the door closer arrangement does not consume relative much power, it has the low-friction arrangements. In this way the operation of the door closer arrangement is smooth as well. The first low-friction arrangement 18 comprises a bearing arrangement 19A, 19B, 20, 21A, 21B, 22, and the second low-friction arrangement 16 comprises a second bearing arrangement 23, 24. As can be seen, the the second end 14 of the arm is connectable with the slide rail 7 through the second low-friction arrangement. FIG. 10 shows a partial view I from FIG. 9. Said low-friction arrangements are obtained by rolling/ball bearings and/or plain bearings comprising friction reducing ingredients/material.

The bearing arrangement can be achieved in many ways. It can be a rolling bearing arrangement in the carriage 17. This arrangement comprising wheels 19A, which are arranged to contact the second rail 9 in a vertical direction, and wheels 19B, which are arranged to contact the second rail 9 in an horizontal direction. In this way the carriage contacts the slide guides via the wheels in the vertical and horizontal directions.

The carriage 17 can comprise four support members 25, which comprises the said wheels 19A, 19B, each support member having at least one wheel 19A in the vertical direction, and at least one wheel 19B in the horizontal direction.

The bearing arrangement can also be a rolling bearing arrangement in the slide guide 9A. See FIG. 11. This arrangement comprises rollers or balls 21A, which are arranged to contact the carriage 17 in a vertical direction, and rollers or balls 21B, which are arranged to contact the carriage 17 in an horizontal direction. As can seen in figure lithe rollers or balls are attached in the bottom 32 part and the side parts 33 of the slide guide 9A, in such a way that the rollers or balls are towards the groove 34 of the slide guide. So, the bottom part 32 and two side parts 33 perform the groove 34 for the carriage 17.

The bearing arrangement can also be a plain bearing wherein the carriage 17 comprises sliding surfaces 20 and the slide guide/s 9A comprising second sliding surfaces 22, the sliding surfaces and/or the second sliding surfaces comprising friction reducing ingredients. The plain bearing can be achieved by using a suitable material/a material layer like Teflon. It is also possible to combine the plain bearing and the described rolling bearing arrangements.

The second bearing arrangement can comprise a ball bearing 23 or a roller bearing, which ball/roller bearing 23 comprises a ring 24 in order to provide a contact with the slide rail 7. See FIGS. 12, 13, and 15. The ring 24 has an outer surface 26 and the inner surface 27, and a width 28 of the ring in the perpendicular direction with respect to a radial of the ring is maximum at the outer surface 26. This arrangement makes it possible that the second bearing arrangement contacts with the slide rail 7 on the outer surface 26 and on the sides 24A of the ring near the outer surface. In this way the sides of the ring at shorter radial areas do not perform resistance when the wheel is rotating.

The second bearing arrangement can also be a plain bearing. This embodiment comprises third slide surfaces 30, 31 comprising friction reducing ingredients. The third slide surfaces are surfaces of a slide piece 29, which contact with the internal surfaces of the slide rail 7. See FIG. 14.

As can be noticed above the invention can be made in many different ways. Further, it can mounted so that the second rail 9 is mountable on the door 2 or on a door frame 3, and the slide rail 7 is mountable on the door or the door frame. The invention performs an easy opening of the door and a safe closing of the door. When the door is closed the function of the tensioned spring of the door closer 6 is improved by the movement of the door closer along the second rail 9 towards the lock side 5 of the door 2. The second rail 9 can be installed on the surface of the door or the door frame being at the zero angle in relation to the surface. Another way is to use the raising part 10 at the first end 9B of the second rail wherein the second rail has a certain angel in relation to the surface of the door or the door frame, and thus the second rail performs the slide slope. The slide slope can reduce power consumption when the door is closed.

It is evident from the above that the invention is not limited to the embodiments described in this text but can be implemented utilizing many other different embodiments within the scope of the independent claims.

The invention claimed is:

1. A door closer arrangement, comprising:

a door closer;

a slide rail;

an arm that connects the door closer with the slide rail;

a second rail;

a carriage configured to be attached to the second rail in a sliding manner, the carriage being arranged to form an attachment with the door closer;

a first low-friction arrangement between the second rail and the carriage;

a second low-friction arrangement between the arm and the slide rail; and an auxiliary motion arrangement secured to the carriage at an exterior of the door closer and configured to aid movement of the carriage and the door closer along the second rail.

2. The door closer arrangement according to claim 1, wherein the auxiliary motion arrangement comprises an electric motor arrangement, or an auxiliary spring arrangement.

3. The door closer arrangement according to claim 2, wherein the auxiliary motion arrangement comprises a raising part at a first end of the second rail, the first end being the end to be installed nearby a hinge side of a door forming a slope for the door closer.

4. The door closer arrangement according claim 3, wherein the second rail comprises a second raising part at a second end of the second rail.

5. The door closer arrangement according to claim 1, wherein the second rail comprises at least one slide guide to form the sliding attachment to the carriage.

6. The door closer arrangement according to claim 5, wherein the first low-friction arrangement comprises a bearing arrangement, and the second low-friction arrangement comprises a second bearing arrangement.

7. The door closer arrangement according to claim 6, wherein the bearing arrangement is a rolling bearing arrangement in the carriage, the bearing arrangement comprising wheels, which are arranged to contact the second rail in a vertical direction, and wheels, which are arranged to contact the second rail in an horizontal direction.

8. The door closer arrangement according to claim 7, wherein the carriage comprises four support members, which comprises the said wheels, each support member having at least one wheel in the vertical direction, and at least one wheel in the horizontal direction.

9. The door closer arrangement according to claim 6, wherein the bearing arrangement is a rolling bearing arrangement in the slide guide, the arrangement comprising rollers or balls, which are arranged to contact the carriage in a vertical direction, and rollers or balls, which are arranged to contact the carriage in an horizontal direction.

10. The door closer arrangement according to claim 6, wherein the carriage comprises sliding surfaces and the slide guide/s comprising second sliding surfaces, the sliding surfaces and/or the second sliding surfaces comprising friction reducing ingredients.

11. The door closer arrangement according to claim 10, wherein the second bearing arrangement comprises third sliding surfaces comprising friction reducing ingredients.

12. The door closer arrangement according to claim 6, wherein the second bearing arrangement comprises a ball bearing or a roller bearing, which ball/roller bearing comprises a ring in order to provide a contact with the slide rail, the ring having an outer surface and the inner surface, and a width of the ring in the perpendicular direction with respect to a radial of the ring being maximum at the outer surface.

13. The door closer arrangement according to claim 6, wherein the slide guide comprises a bottom part and two side parts, the bottom part and the side parts performing a groove for the carriage.

14. The door closer arrangement according to claim 1, wherein the second rail is mountable on the door or on a door frame, and the slide rail is mountable on the door or the door frame.

15. The door closer arrangement according to claim 1, wherein the auxiliary motion arrangement comprises a raising part at a first end of the second rail.

16. The door closer arrangement according to claim 15, wherein the first end is configured to be installed nearby a hinge side of a door.

* * * * *